US007395637B2

(12) United States Patent
Angelini

(10) Patent No.: US 7,395,637 B2
(45) Date of Patent: Jul. 8, 2008

(54) DEVICE FOR MANUFACTURING WRAPPING SHEETS PROVIDED WITH HANDLES

(75) Inventor: Davide Angelini, Calderara di Reno (IT)

(73) Assignee: KPL Packaging S.p.A., Via Fattori (IT)

( * ) Notice: Subject to any disclaimer, the term of this patent is extended or adjusted under 35 U.S.C. 154(b) by 1 day.

(21) Appl. No.: 10/997,082

(22) Filed: Nov. 23, 2004

(65) Prior Publication Data

US 2005/0132665 A1 Jun. 23, 2005

(30) Foreign Application Priority Data

Nov. 28, 2003 (EP) ..... 03425768

(51) Int. Cl.
*B65B 61/14* (2006.01)
*B65B 41/18* (2006.01)

(52) U.S. Cl. ..... 53/134.1; 53/176

(58) Field of Classification Search ..... 53/134.1, 53/176, 594, 413; 493/226
See application file for complete search history.

(56) References Cited

U.S. PATENT DOCUMENTS 3,557,516 A 1/1971 Brandt
3,892,614 A 7/1975 Levy
4,419,855 A 12/1983 Shanklin
4,786,353 A * 11/1988 Templeton et al. ..... 156/359
5,816,993 A * 10/1998 Fowler et al. ..... 493/226
6,138,437 A * 10/2000 Focke et al. ..... 53/133.7
6,207,925 B1 * 3/2001 Kendall ..... 219/121.63

FOREIGN PATENT DOCUMENTS

DE 43 32 419 4/1994
GB 2 271 098 4/1994

* cited by examiner

*Primary Examiner*—Rinaldi I. Rada
*Assistant Examiner*—John Paradiso
(74) *Attorney, Agent, or Firm*—Klarquist Sparkman, LLP

(57) ABSTRACT

The manufacture of wrapping sheets provided with respective handles is accomplished by obtaining the wrapping sheets and the handles from respective strips of heat-sealable material, which are mutually coupled by means of a coupling device able electrically to charge the strips with respective electrical charges of opposite sign.

8 Claims, 1 Drawing Sheet

DEVICE FOR MANUFACTURING WRAPPING SHEETS PROVIDED WITH HANDLES

CROSS REFERENCE TO RELATED APPLICATIONS

This application claims priority under 35 U.S.C. § 119 from European Patent Application No. 03425768.3, filed Nov. 28, 2003. The prior application is incorporated herein by this reference.

BACKGROUND

The present invention relates to a device for manufacturing wrapping sheets provided with related handles.

In particular, the present invention relates to a device for manufacturing wrapping sheets for packaging paper rolls taken individually or in groups constituted by a plurality of paper rolls, positioned adjacent to each other and aligned, whereto the present description shall explicitly refer without thereby losing its general nature.

According to the prior art in the paper roll industry, the paper rolls are packaged within related wrapping sheets, each of which is obtained from a first strip of heat-sealable material, is wrapped around one or more paper rolls to form a paper roll package, and is associated to a handle able to allow the consumer conveniently to grip the package itself.

Generally, the handles are obtained from a second strip of heat-sealable material, whose width is smaller than the width of the first strip, is superposed to the first strip, and is joined to the first strip by means of a coupling device that is normally able to seal or glue the two strips.

Once the two strips are joined and a third strip of heat-sealable material is obtained, the wrapping sheets and the related handles are obtained in succession by cutting the third ribbon transversely to a direction of advance thereof.

The known devices described above have some drawbacks, mainly deriving from the tact that the solutions adopted by said devices for joining the aforesaid first and second strip are relatively complex and entail in one case heat-shrinking phenomena, which occur at the end of the sealing operation, are located solely in the area of superposition of the two ribbons, and can, therefore, cause said superposition area to be shortened and narrowed relative to the remaining part of the wrapping sheet, compromising the correct formation of the roll package, and in the other case the known problems connected with the use of glue.

SUMMARY

An object of the present invention is to provide a device for manufacturing wrapping sheets provided with related handles which is free from the aforesaid drawbacks and is simple and economical to construct.

According to one embodiment, a device for manufacturing wrapping sheets provided with related handles, the wrapping sheets and the handles being obtained from a first and, respectively, a second strip of heat sealable material, the device comprising a station for coupling the first strip with the second strip; feeding means to feed the first and the second ribbon to said coupling station; and coupling means to couple the first and the second strip to each other and form a third strip; and being characterised in that said coupling means comprise electric means for charging the first and the second strip with respective electrical charges of opposite sign.

BRIEF DESCRIPTION OF THE DRAWING

The present invention shall now be described with reference to the accompanying FIG. 1, which schematically shows a lateral elevation view, with some parts enlarged and some parts removed for the sake of clarity, of an embodiment provided purely by way of non limiting example.

DETAILED DESCRIPTION

Figure 1:
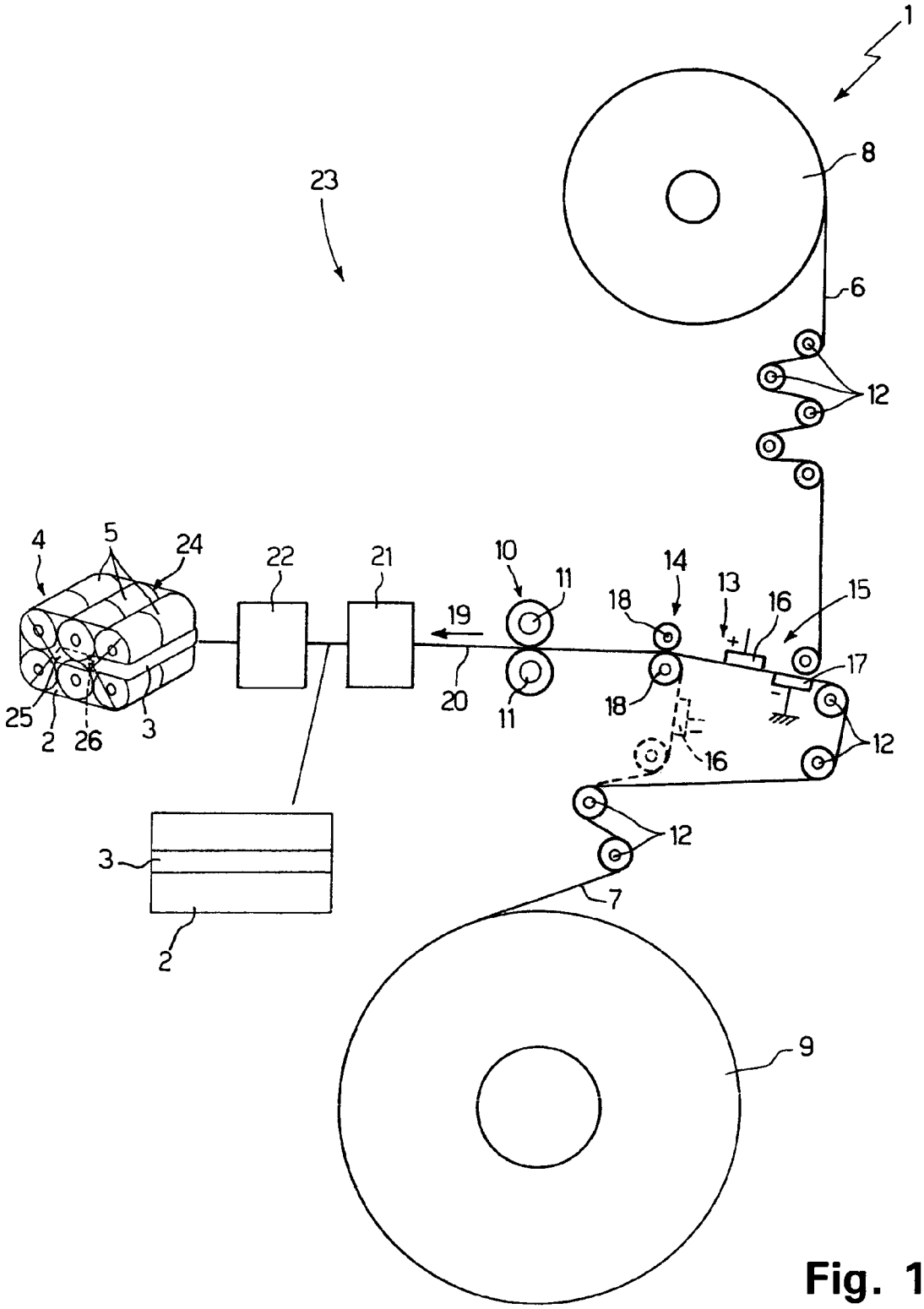

With reference to the accompanying FIG. 1, the reference number 1 globally designates a device for manufacturing wrapping sheets 2 provided with respective handles 3 and able to be wrapped around respective groups 4 of paper rolls 5.

The sheets 2 and the handles 3 are obtained from respective strips 6, 7 of heat-sealable material, whereof the strip 6 has a width greater than the width of the strip 7, which strips are unwound from respective reels 8, 9 by means of a known unwinding device 10 comprising at least a pair of unwinding rollers positioned substantially in contact with each other with the interposition of the strips 6, 7 and, for each strip 6, 7, respective plurality of transmission rollers 12.

The strips 6, 7 are fed by the device 10 to a coupling station 13 provided with a coupling unit 14 comprising an electrical device 15 able electrically to charge the strips 6,7 with respective electrical charges of opposite sign and to cause the adhesion of the entire strip 7 on the strip 6 due to the electrostatic attraction force generated by said electrical charges. The device 15 comprises, for each strip 6, 7, a respective electrostatic generator 16 or ioniser or a generator 16 for each of the strips 6, 7 and a ground connection 17 for the other strip 6, 7.

The unit 14 further comprises a pair of presser rollers 18 positioned downstream of the device 15 in a direction 19 of advance of the strips 6, 7 to press the strips 6, 7 firmly against each other and form a third strip 20 of heat-sealable material, which is fed to a known cutting device 21 able to engage the ribbon 20 transversely to the direction 19 and to separate in succession from the strip 20 the sheets 2 and the related handles 3.

Lastly, each sheet 2 and the related handle 3 are fed to a wrapping and sealing unit 22 defining, together with the device 1, a packaging machine 23, and are wrapped around a related group 4 of rolls 5 in such a way as to form an external wrapper 24 with two mutually opposite end superposition areas 25, each of which is folded substantially in contact with the rolls 5 with the interposition of a free end 26 of the related handle 3, and is stabilised by means of a respective sealing operation.

It should be specified, lastly, that at the output from the unit 22 the effect of the electrostatic attraction between each sheet 2 and the related handle 3 ceases, so said handle 3 remains connected to the wrapper 24 solely in correspondence with its ends 26.

The operation of the device 1 is readily apparent from the above description and requires no additional explanations.

The invention claimed is:

1. A method for packaging a product including the following steps:

unwinding a first strip and a second strip of heat sealable material;

electrostatically charging said first and second strip of heat sealable material with opposite electric charges;

electrostatically coupling said first and second strip of heat sealable material and advancing said electrostatically coupled first and second strip towards a wrapping station;

cutting a length of said electrostatically coupled first and second strip of heat sealable material, forming a sheet of heat sealable material and a handle of heat sealable material, said handle having a first end and a second end, and said sheet and said handle electrostatically adhering one to the other;

wrapping said first sheet of heat sealable material around a product, forming a first pair and a second pair of superposed sheet edges on opposite sides of said product, the first and the second end of said handle being arranged between the superposed sheet edges of said first pair and second pair respectively; and heat sealing the edges of each said first and second pair of sheet edges with the respective handle ends therebetween, such that the handle remains sealingly connected to the first sheet in correspondence of the ends thereof.

2. A method for packaging a product with a heat sealable wrapping sheet and a handle, wherein:

a heat sealable sheet and a heat sealable handle are temporarily adhered one to the other by means of electrostatic attraction, said handle having a first end and a second end;

wrapping said sheet around said product to form two opposed pairs of overlapping sheet portions with each of said first and second ends of said handle being arranged between a respective one of said pairs of overlapping sheet portions; and heat sealing said overlapping sheet portions and said handle ends arranged therebetween to form said packaging.

3. A packaging machine comprising a device for manufacturing wrapping sheets provided with related handles; the wrapping sheets and the handles being obtained from a first and, respectively, a second strip of heat sealable material, the manufacturing device comprising a station for coupling the first strip with the second strip; feeding means to feed the first and the second strips to said coupling station; coupling means to couple the first and the second strip to each other and form a third strip; and a cutting device to separate in succession said wrapping sheets and said related handles from said third strip; the packaging machine further comprising a wrapping device to wrap each wrapping sheet and the related handle around a respective product and form an external wrapper having two mutually opposite end superposition areas containing the free ends of the handle; and a sealing device to stabilise said end superposition areas by means of respective sealing operations; wherein said coupling means comprise electric means for charging the first and the second strip with respective electrical charges of opposite sign; said wrapping device being able to fold each said end superposition area substantially in contact with the product with the interposition of one said free end of the handle in each said superposition area, and said sealing device being able to heat-seal said superposition areas such that, when the effect of the electrostatic attraction between the wrapping sheet and the related handle ceases, the handle remains connected to the external wrapper with its free ends sealingly engaged to said external wrapper in said superposition areas.

4. A packaging machine as claimed in claim 3, wherein said electrical means comprise, for each of said first and second strip, a respective electrostatic generator.

5. A packaging machine as claimed in claim 3, wherein said electric means comprise an electrostatic generator to charge one of said first and second strip and a ground connection to charge the other of said first and second strip.

6. A packaging machine as claimed in claim 3, wherein said coupling means comprise presser means able to press said first and second strip firmly against each other.

7. A product packaging machine including:

a first unwinder for unwinding a first strip of heat sealable material;

a second unwinder for unwinding a second strip of sealable material;

a coupling station including electric chargers for charging said first and said second strip with respective electric charges of opposite signs and for electrostatically and temporarily adhering said first and second strip to one another;

downstream of said coupling station a cutter for cutting said electrostatically adhering first and second strip, thus forming individual wrapping sheets each formed by a portion of said first strip, and each wrapping sheet being provided with a respective handle formed by a portion of said second strip, said handle having first and second ends; and a wrapping station for wrapping each wrapping sheet and the related handle around a product and forming an external wrapper, said external wrapper including two mutually opposite end superposition areas of said wrapping sheet, each superposition area being formed by a pair of folded and superposed edges of said wrapping sheet, a respective one of said handle ends being arranged between a respective one of said pairs of superposed edges, and wherein said wrapping station includes a heat sealing device for heat-sealing each said pair of superposed edges and the respective handle end therebetween.

8. A packaging machine as claimed in claim 7, wherein said coupling station includes a presser to press said first and second strip firmly against each other.

* * * * *